US005727409A

United States Patent [19]

Inoue et al.

[11] Patent Number: 5,727,409

[45] Date of Patent: Mar. 17, 1998

[54] METHOD OF CONTROLLING A TERMINAL CRIMPING APPARATUS

[75] Inventors: Toshihiro Inoue; Masao Igarashi; Kazuhiko Takada, all of Shizuoka, Japan

[73] Assignee: Yazaki Corporation, Tokyo, Japan

[21] Appl. No.: 576,019

[22] Filed: Dec. 21, 1995

[30] Foreign Application Priority Data

Dec. 28, 1994 [JP] Japan ..... 6-328827

[51] Int. Cl.[6] ..... H01R 43/048

[52] U.S. Cl. ..... 72/21.1; 72/19.8; 72/412; 29/863; 29/709; 29/753

[58] Field of Search ..... 72/17.2, 20.1, 72/21.1, 21.4, 21.5, 19.8, 19.9; 29/709, 710, 705, 593, 863, 753

[56] References Cited

U.S. PATENT DOCUMENTS

| | | | |
|---|---|---|---|
| 4,916,810 | 4/1990 | Yeomans | 29/863 |
| 5,069,060 | 12/1991 | Ishii . | |
| 5,079,489 | 1/1992 | Ishii . | |
| 5,113,679 | 5/1992 | Ferraro | 72/21.1 |
| 5,115,735 | 5/1992 | Gloe et al. . | |
| 5,129,317 | 7/1992 | Gloe et al. . | |
| 5,197,186 | 3/1993 | Strong | 29/753 |
| 5,271,254 | 12/1993 | Gloe | 29/753 |
| 5,299,463 | 4/1994 | Gross | 29/753 |
| 5,337,589 | 8/1994 | Gloe | 72/441 |

FOREIGN PATENT DOCUMENTS

| | | |
|---|---|---|
| 3-189037 | 8/1991 | Japan . |
| 5-29055 | 2/1993 | Japan . |
| 5-29056 | 2/1993 | Japan . |
| 6-25911 | 7/1994 | Japan . |

*Primary Examiner*—Daniel C. Crane
*Attorney, Agent, or Firm*—Armstrong, Westerman, Hattori, McLeland & Naughton

[57] ABSTRACT

A terminal crimping apparatus is equipped with a vertically reciprocating crimper for crimping a terminal to an exposed conductive portion of an electric wire and an anvil opposing to the crimper. The crimper is vertically reciprocated by an activation device, such as a servo-motor. The apparatus has a sensor to monitor a load applied to the activation device or to monitor the height of the crimper when the terminal is crimped. A driver control for the apparatus includes a decision section comparing the monitored load or the monitored crimper height with predetermined reference data to determine whether the terminal is correctly crimped.

10 Claims, 11 Drawing Sheets

METHOD OF CONTROLLING A TERMINAL CRIMPING APPARATUS

BACKGROUND OF THE INVENTION

1. Field of the Invention

This invention relates to a method of controlling a terminal crimping apparatus that manufactures terminal, equipped wires to produce a wire harness or the like.

2. Description of the Prior Art

There has been used for a long time a terminal crimping apparatus provided with a flywheel, as shown in FIG. 9, as one of the instant type for performing the crimping method. In the apparatus, the flywheel 101, driven by a motor (not shown,) rotates at a constant speed in the direction of an arrow head, and a crank arm 103 pivotably attached to an off-center pin 102 pivots around a pivot axis 104. Further, the crank arm 103 vertically reciprocates a ram 107 pivotably attached by an axial pin 106 to the crank arm 103 by way of a connection arm 105, which vertically reciprocates a crimper 108 integrally connected to the ram 107. Thereby, the crimper 108 and a cooperative anvil 109 compress and crimp a stripped wire end w of a wire W to a barrel c of a terminal C.

The above-mentioned flywheel-type crimping apparatus is suitable for mass production because the crimper 108 vertically reciprocates with higher speeds. However, as the crimper 108 passes instantaneously its bottom dead point (that is, it is not stopped at the bottom dead point), its crimping operation is instantaneous, resulting in the disadvantage of an insufficient tensile strength in the crimped terminals. FIG. 11 shows the relation between time and position of the crimper 108 and explains that a crimping, contacting period to of the crimper 108 and the terminal C is only an instant. Moreover, the crimping apparatus has the disadvantages that the size of the flywheel 101 determines the press depth (crimp height), that the motor running cost is large, and that it is difficult to detect an abnormal state during crimping operation. Additionally, a crimp height is not easily adjusted because only a lowest position of the crimper is selected so that the anvil height should be modified in a crimp height adjustment.

Besides, in Japanese Utility Model Publication No. Hei 6-25911, there is provided a crimping apparatus, as shown in FIG. 10, having a crimper 108' vertically moved by the rotation of a lead screw 110. Designated 111 is a servo-motor, 112 a primary wheel, 113 a secondary wheel, and 114 a timing belt.

Nevertheless, the above-mentioned lead-screw-type crimping apparatus also has the disadvantages that a large-scale apparatus is required to obtain a larger crimping load, that its operation speed is normally lower to result in lower productivity, and that many sensors are required to determine a whether terminal is correctly crimped, or otherwise a manual determination is required. Additionally, the screw mechanism is not suitable to a minute adjustment of crimp height.

SUMMARY OF THE INVENTION

In view of the aforementioned drawbacks, an object of the invention is to provide a method of controlling a terminal crimping apparatus that can control the apparatus without many sensors and, further, can accurately detect defectively crimped terminals due to abnormal crimping operations.

To achieve the above-mentioned object, according to a first aspect of this invention, a method of controlling a terminal crimping apparatus that is equipped with a vertically reciprocating crimper for crimping a terminal to an exposed conductive portion of an electric wire and an anvil opposing to the crimper, wherein the crimper is activated in the vertical direction by an activation means, such as a servo-motor, the method comprising the step of; monitoring a load applied to the activation means when the terminal is crimped; and comparing the detected load with predetermined reference data to determine whether the terminal is correctly crimped.

Preferably, according to a second aspect of this invention, the monitoring operation of the load applied to the activation means is conducted at a terminal crimping position.

According to a third aspect of this invention, the control method further comprises the step of determining whether the crimping has been normally carried out based upon the maximum value of the load during a predetermined period.

According to a fourth aspect of this invention, the control method further comprises the step of determining whether the crimping has been normally carried out based on the difference between load values and the reference loads during a predetermined period.

According to a fifth aspect of this invention, the control method further comprises the step of determining whether the crimping has been normally carried out based upon the sum of the load values during a predetermined period.

According to a sixth aspect of this invention, a method of controlling a terminal crimping apparatus that is equipped with a vertically reciprocating crimper for crimping a terminal to an exposed conductive portion of an electric wire and an anvil opposed to the crimper, wherein the crimper is activated in the vertical direction by an activation means, such as a servo-motor, the method comprising the steps of; monitoring a height of the crimper when the terminal is crimped; and comparing the detected crimper height with a predetermined reference datum to determine whether or not the terminal is correctly crimped.

A seventh aspect of this invention, in addition to the sixth aspect of the invention, includes that the monitoring operation of the height of the crimper is conducted at a terminal crimping position.

An eighth aspect of this invention, in addition to the sixth aspect of the invention, includes the step of determining whether the crimping has been normally carried out based on the minimum value of the crimper height during a predetermined period.

A ninth aspect of this invention, in addition to the sixth aspect of the invention, includes the step of determining whether the crimping has been normally carried out based on the difference between the crimper height and a reference crimper height during a predetermined period.

According to a tenth aspect of this invention, a method of controlling a terminal crimping apparatus that is equipped with a vertically reciprocating crimper for crimping a terminal to an exposed conductive portion of an electric wire and an anvil opposing the crimper, wherein the crimper is activated in the vertical direction by an activation means, such as a servo-motor, the method comprising the steps of; monitoring a load applied to the activation means when the terminal is crimped; monitoring a height of the crimper when the terminal is crimped; and comparing the detected load with a predetermined reference datum and comparing the detected crimper height with a predetermined reference datum to determine whether the terminal is correctly crimped.

Referring to effects of the present invention, defectively crimped terminals due to abnormal crimping operations can be detected by monitoring a load (for example, a load current) applied to the activation means when the terminal is crimped. Thereby, there is no requirement for many sensors to detect a bottom dead position of the crimper, a crimped height of a terminal barrel, a crimped profile, and the like, thereby resulting in provision of a simplified crimping apparatus.

Further, this invention includes the steps of monitoring a height of the crimper when the terminal is crimped and comparing the detected crimper height with a predetermined reference datum to determine whether the terminal is correctly crimped, thereby resulting in provision of a simplified apparatus capable of determining whether the terminal is correctly crimped.

DETAILED DESCRIPTION OF PREFERRED EMBODIMENTS

Figure 1:
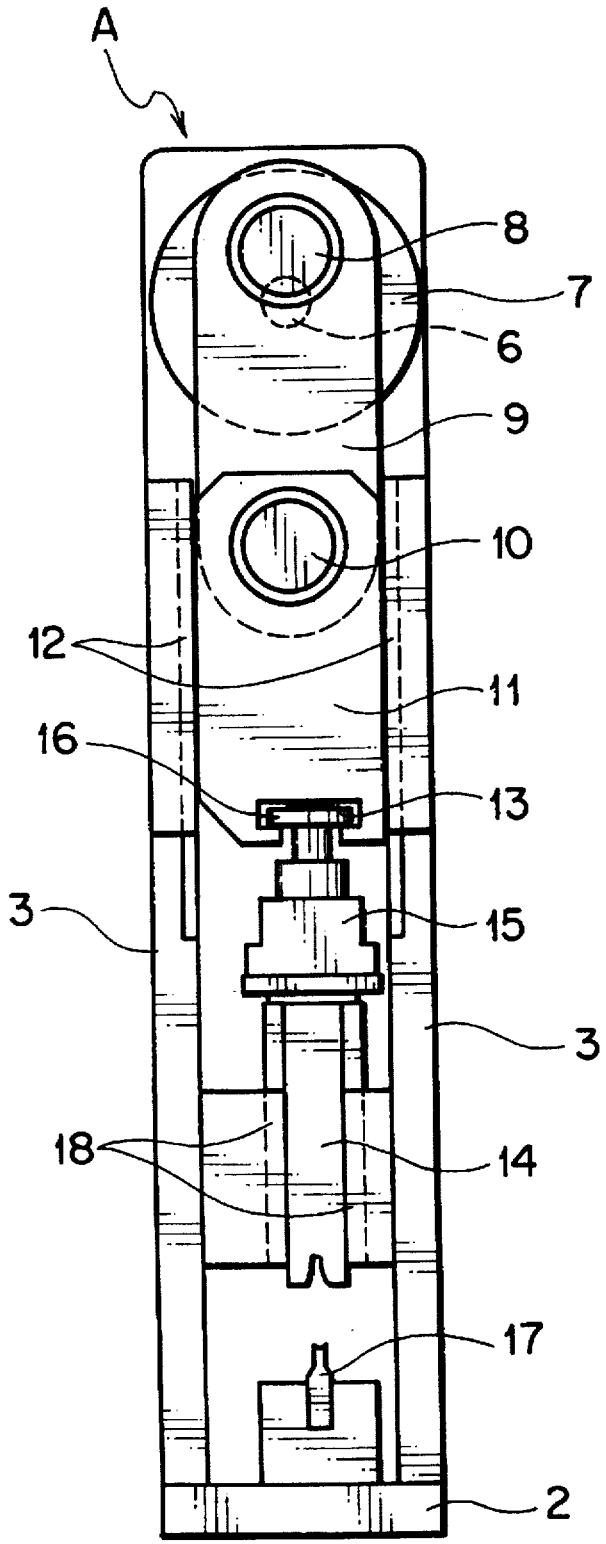
FIG. 1 is the front view showing an embodiment of a terminal crimping apparatus according to this invention.
Figure 2:
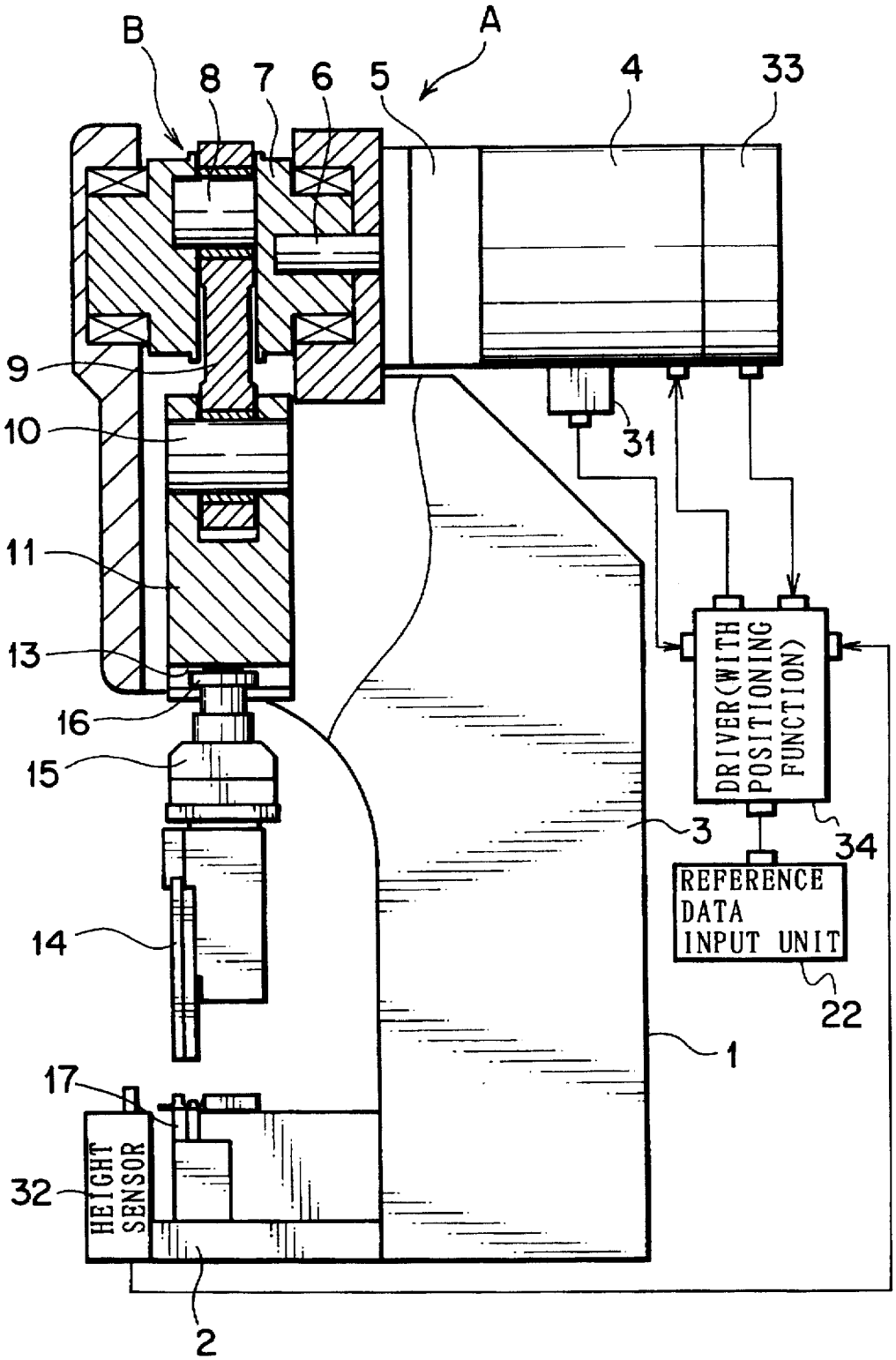
FIG. 2 is a side view of the terminal crimping apparatus in FIG. 1.

In FIGS. 1 and 2, designated as 1 is a casing for a terminal crimping apparatus A according to the present invention, which has a base plate 2 and side plates 3, 3 positioned on each side of the base plate 2. In the rear of, and above, both the side plates 3, 3, there is provided and fixed an electrical servo-motor 4 with a reduction gear 5. The reduction gear 5 has an output axis 6 that axially connects to a circular plate 7 with an off-center pin 8. The off-center pin 8 is slidably axially connected to an upper end portion of a crank arm 9, a lower end portion of which being pivotably axially connected to a ram 11 by way of an axial pin 10. The ram 11 is disposed to slide upward and downward in ram guides 12, 12 provided on inner surfaces of both the side plates 3, 3. The circular plate 7, the crank arm 9, the ram 11 and the ram guides 12, 12 compose a piston-crank mechanism B.

The ram 11, at a lower end thereof, has an engaging recess or slot 13. The engaging recess or slot 13 detachably engages with an enlarged head portion 16 of a crimper holder 15 holding a crimper 14. Just below the crimper 14, an anvil 17 is fixed on the base plate 2 in opposition to the crimper 14. Designated 18 is a guide plate for guiding the crimper holder 15, the guide plate 18 being fixed to an inner surface of the side plate 3 by way of a bracket (not shown).

The servo-motor 4 can rotate forwardly and reversely, which vertically reciprocates the crimper 14 by way of the ram 11 pivotably attached to the crank arm 9 by the piston-crank mechanism B. Further, the servo-motor 4 connects to a driver control device 34 that controls the servo-motor operation. The driver control device 34 connects to a reference data input unit 22 that inputs reference data, such as terminal specifications (or terminal sizes), relative wire sizes, crimp heights (lowest descended positions of the crimper), and loads (electric currents) to be applied to the servo-motor 4. Further, on an output axis (not shown) of the servo-motor 4 there is attached a rotary encoder 33 that detects positions of the crimper 14 based on the extent of rotation of the servo motor and feeds the information back to the driver control device 34 that reads out the above-mentioned load current.

Designated 32 is a height sensor that senses the height of the crimper 14 just when a terminal is crimped. The sensor 32 is operative to output the sensed height to the driver control device 34 that determines whether the terminal crimping operation is correct. Furthermore, designated 31 is a temperature sensor for sensing the temperature of a coil in the servo-motor 4.

Figure 3:
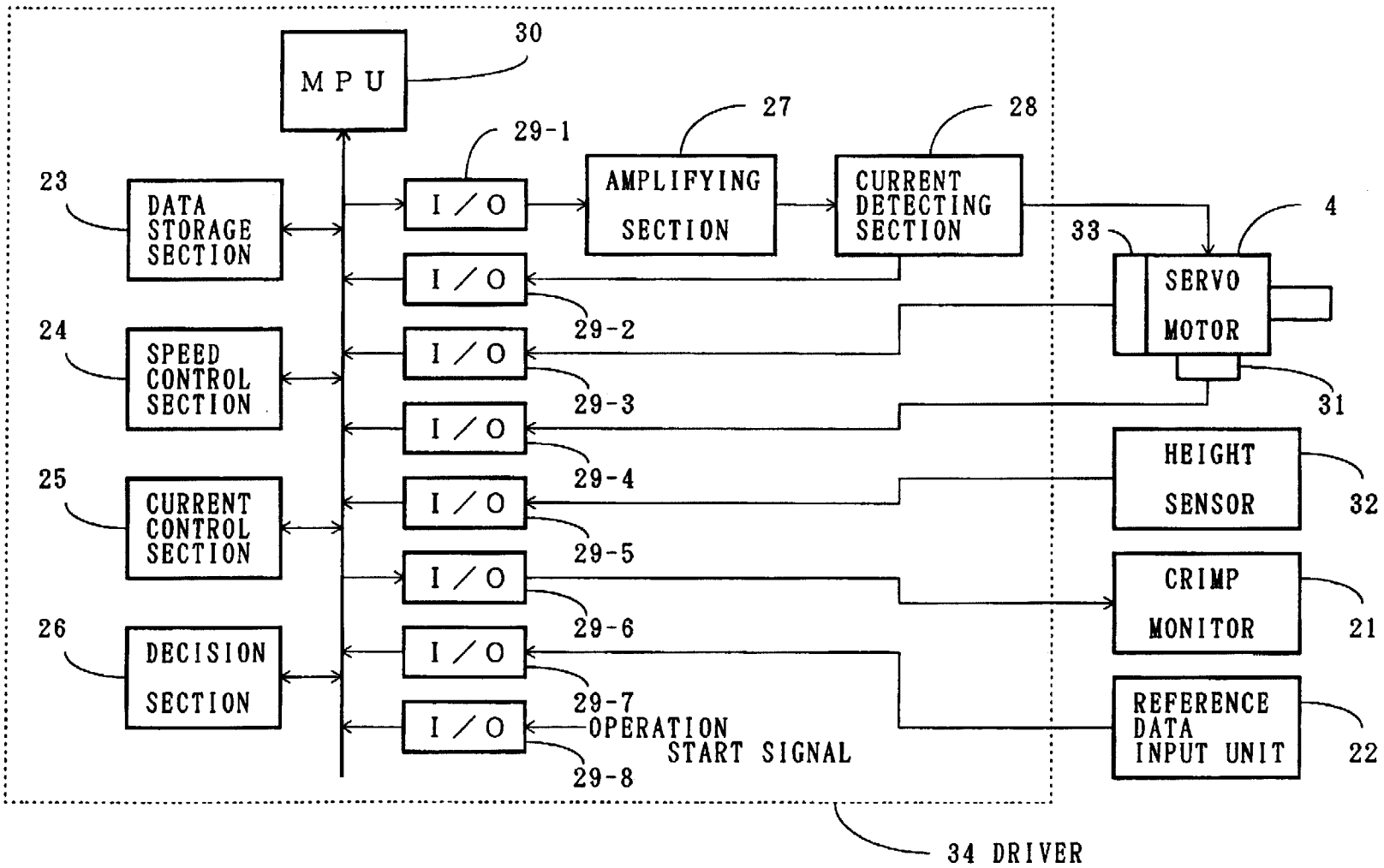
FIG. 3 is a functional block diagram showing a control system of the terminal crimping apparatus in FIG. 1.

FIG. 3 is a functional block diagram of the driver control device 34 that controls the servo-motor 4 in operation. As shown in the figure, the driver control device 34 is integrated as a control circuit, such as a central processing unit, and includes a data storage section 23, a speed control section 24, a current control section 25, a decision section 26, an amplifying section 27, a current detecting section 28, interfaces I/O 29-1 to 29-8, and a microprocessor unit(MPU) 30.

Next, before explaining detailed operation of the embodiment of the present invention, the basic operation of the embodiment is discussed referring to FIGS. 6 and 7.

Figure 6C:
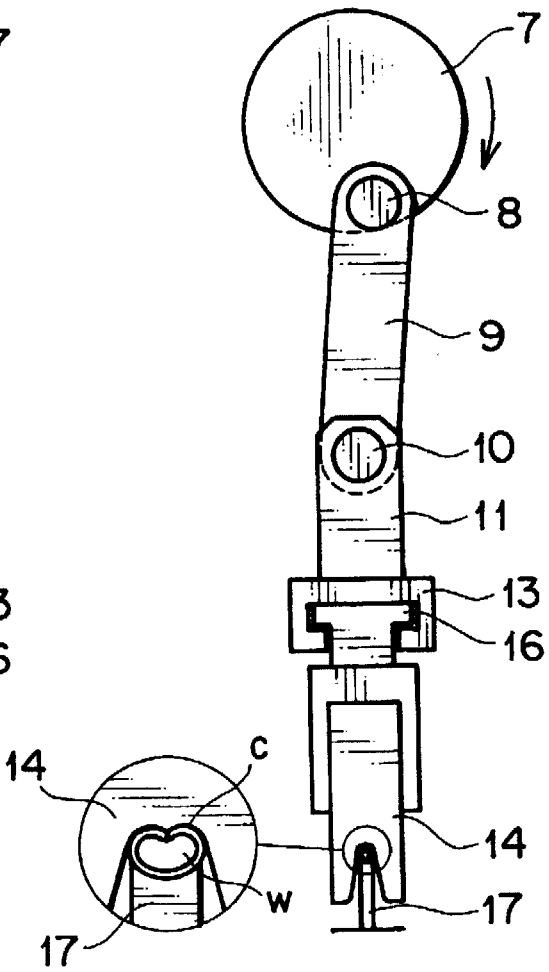
FIGS. 6A, 6B and 6C are illustrations respectively showing various operation steps of the terminal crimping apparatus in FIG. 1.
Figure 6B:
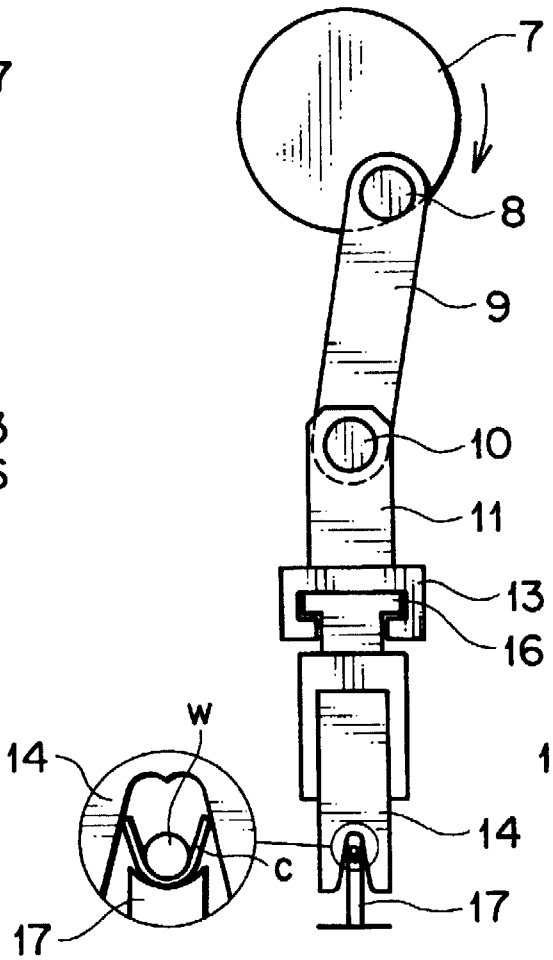
Figure 6A:
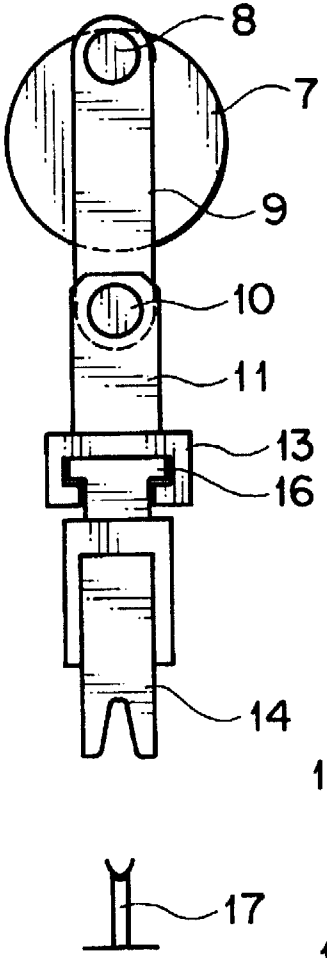
Figure 7A:
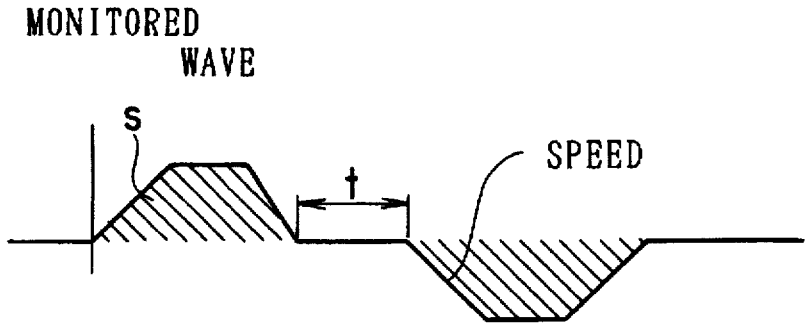
FIG. 7A is a graph showing the relation between time and the vertically reciprocating speed of a crimper in a crimping operation cycle controlled by the control system in FIG. 3.
Figure 7B:
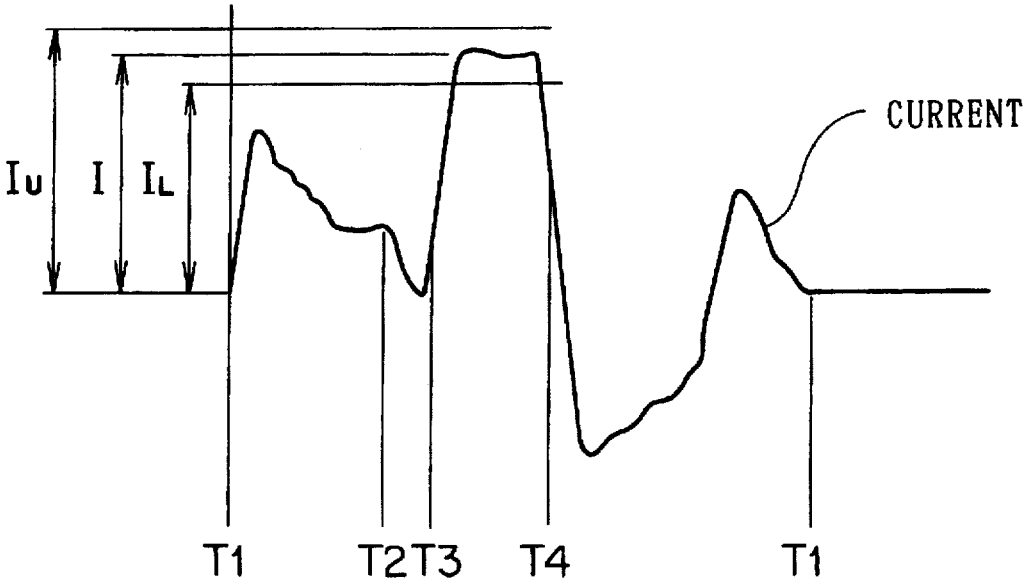
FIG. 7B is a graph showing the relation between time and the motor current of the same.

FIGS. 6A, 6B and 6C are diagrams explaining the operation of the terminal crimping apparatus. FIG. 7A is a graph showing the relation between time and the vertically reciprocating speed of the crimper 14 in the operation. Further, FIG. 7B is a graph showing the relation between time and the current of the servo-motor in the same operation. Besides, the points designated as T1, T2, and T3 in FIGS. 7B correspond to the respective conditions of the apparatus shown in FIGS. 6A, 6B, and 6C.

FIG. 6A shows an initial step in the terminal crimping operation, in which the off-center pin 8 on the circular plate 7 is at the highest position, that is, the crimper 14 is at the top dead point. At that time, as shown in FIG. 7A, the descending speed of the crimper 14 is zero and the load current in the servo-motor 4 is also zero.

FIG. 6B shows an initial crimping step, in which the circular plate 7 rotates in the arrow head direction; the off-center pin 8 moves downward; and the crimper 14 has descended at a higher speed before abutting the barrel c of the terminal C. However, the descending speed of the crimper 14 is decelerated and the load current for the servo-motor is reduced prior to the abutment.

FIG. 6C shows a stopping state in which the crimper 14 has stopped at its crimping position, after the circular plate 7 rotates in the arrow head direction so that the off-center pin 8 reaches near its bottom dead point and the crimper 14 and anvil 17 carry out a crimping operation. At that time, as the crimper 14 has been stopping during a stopping period t, the crimper 14 operates to press the barrel c of the terminal C so as to continue to oppose against spring-back of the barrel c. Thereby, the load current reaches to a peak of a maximum rate. The press in the stopping state eliminates the spring-back of the barrel c to obtain a high crimping strength.

After the terminal is crimped, the servo-motor 4 reversely rotates, that is, the circular plate 7 rotates in the reverse direction to the arrow head in FIG. 6C so that the crimper ascends to return to the original state of FIG. 6A.

In FIG. 7A, at the crimping start position, that is, at T2, the descending speed of the crimper 14 is considerably smaller than the speed in which the crimper 14 descends from the top position to the crimping start position. Therefore, there are no impulsive noises generated in the conventional flywheel-type crimping apparatus, which reduces noise to provide an improved working environment.

Further, referring to FIG. 3 again, before the apparatus is operated, the data storage section 23 stores data for operating the crimping apparatus A and data for determining whether terminals are correctly crimped from the reference data input unit 22 by way of I/O 29-7.

The stored data for operating the crimping apparatus A are accelerated speeds of the servo-motor after the servo-motor begins to normally rotate at T1, a position of the crimper 14 when the crimper descending speed reaches a uniform rate during the descending of the crimper 14 activated by the motor rotation, a position of the crimper 14 and decelerated speeds of the crimper 14 when the crimper decelerates from the uniform rate at T2, a crimping start position of the crimper 14 at T3, a given time t and a driving current to drive the servo-motor during the given time, accelerated speeds of the servo-motor when the servo-motor begins to reversely rotate to ascend the crimper 14 after a terminal is crimped at T4, a position of the crimper 14 when the crimper ascending speed reaches to another uniform rate, a position of the crimper 14 when the crimper decelerates from another uniform rate, and a stop position of the crimper 14.

Moreover, data of the positions of the crimper 14 are stored as corresponding to output values from the rotary encoder 33 attached to the servo-motor 4.

These data are preliminarily, experimentally obtained respectively for each crimped terminal size to be stored. Further, the data corresponding to plural types of terminals may be preliminarily stored so that any one of the data may be read out when required in a crimping operation.

Moreover, position data of the crimper 14 are stored to correspond to output values of the rotary encoder 33, that is, as corresponding to pivoting angles of the circular plate 7. Thereby, even for different types of terminals, the crimp height can be promptly modified without changing a height of the anvil 17 in a prior art, and the crimp height can be easily, minutely adjusted when a crimping operation starts, if required.

Further, the data for determining whether terminals are correctly crimped include, as described later in detail, currents IU and IL shown in FIG. 7B, or the like. In FIG. 7B, I denotes a detected current when a certain terminal is normally crimped to a corresponding size wire; IU and IL denote an upper limit and a lower limit of the detected current, respectively, IU and IL being determined based on a preliminary test result. The graph of FIG. 7 shows a normal crimping in which I is between IL and IU.

Figure 4:
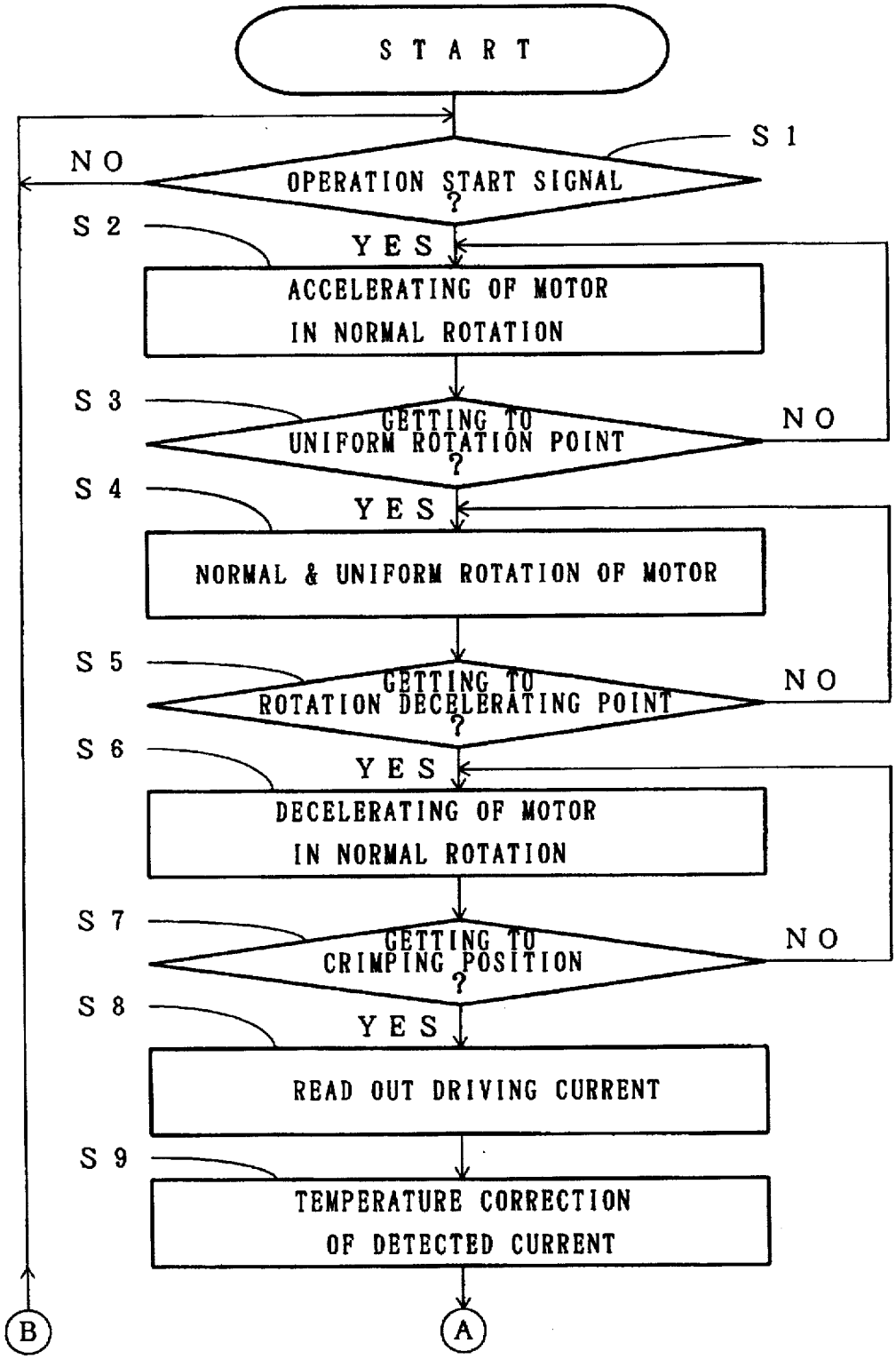
FIG. 4 is a flow chart showing a first part of the operation of the control system of FIG. 3.
Figure 5:
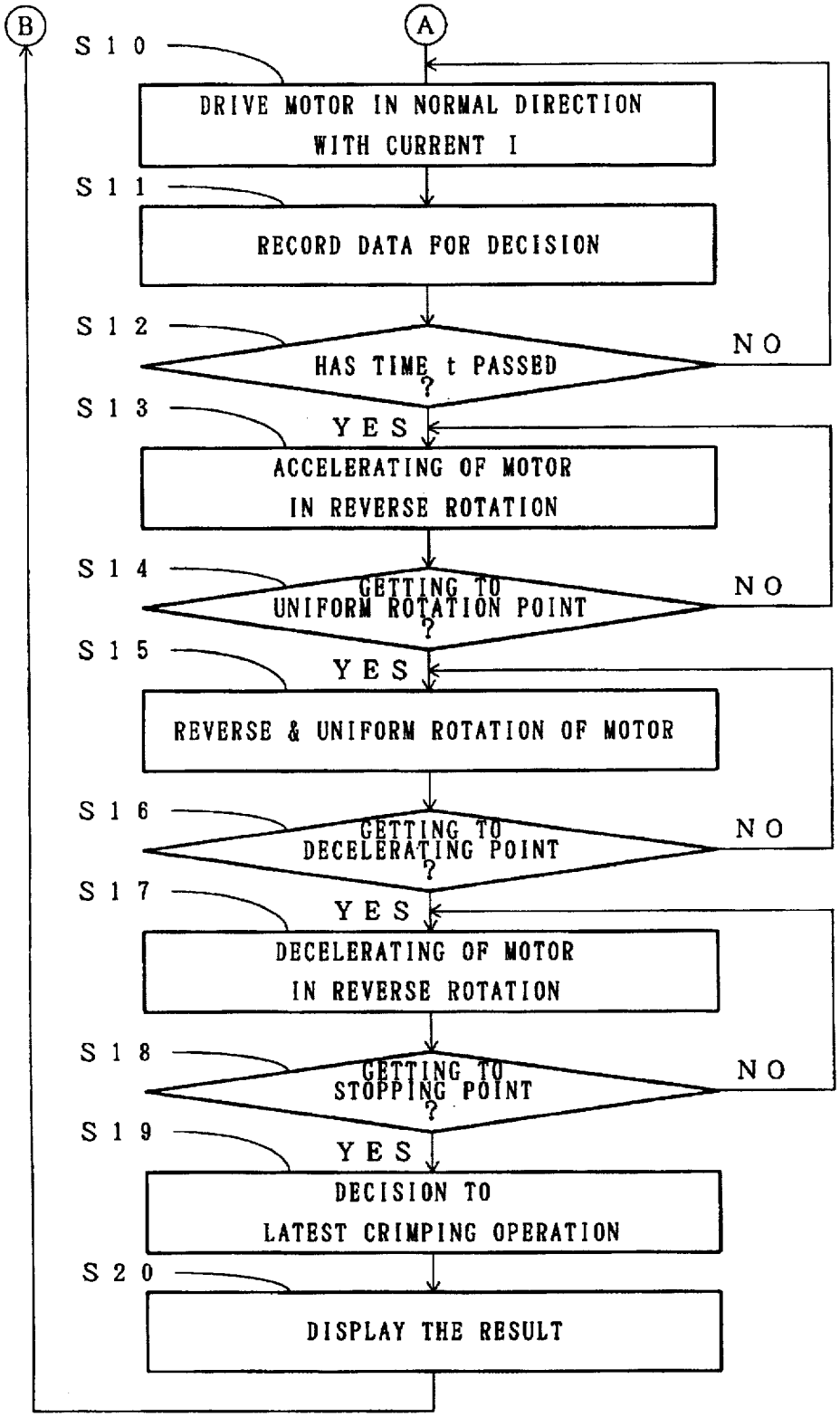
FIG. 5 is a flow chart showing a remaining part of the operation of the control system of FIG. 3.

Next, referring to FIGS. 4 and 5, the operation of the driver 34 will be discussed. FIGS. 4 and 5 show operational flow charts of the driver 34.

In step S1, the speed control section 24 decides whether a starting signal to begin a crimping operation is inputted by way of I/O 29-8, and if the decision is NO, the operation does not start until the decision becomes YES.

In step S2, the speed control section 24 reads out a normally accelerated rotating speed of the servo-motor 4 from the data storage section 23, and outputs a signal to the amplifying section 27 by way of I/O 29-1 so that the amplifying section 27 supplies a current to the servo-motor 4 in such way that the servo-motor 4 rotates at the read out accelerated speed.

The values outputted from the rotary encoder 33 by way of I/O 29-3 are differentiated to obtain rotation speeds of the motor and further the rotation speeds are differentiated to determine rotation accelerations of the motor.

In step S3, The speed control section 24 determines whether a value outputted from the rotary encoder 33 by way of I/O 29-3 becomes equal to the value that is stored in the data storage section 23 and corresponds to a position from which a uniform rotation speed begins. If the decision is NO, step S2 continues to accelerate the motor, while if the decision is YES, a following step S4 makes the motor rotate at a uniform speed.

Further, when step S5 in the speed control section 24 detects the arrival at the deceleration starting position of the motor, the following step S6 decelerates the rotation of the motor. The next step S7 decides whether the crimper has reached the terminal crimping position, and if the decision is YES, the step S7 outputs a corresponding signal to the current control section 25.

In the current control section 25, step S8 reads out a current I stored in the data storage section 23 and which is required by the servo-motor 4 just in a crimping stage. The next step S9 corrects the current I based on a temperature outputted from the temperature sensor 31 by way of I/O 29-4 so that the motor torque becomes equal to the reference value. Further, the following step S10 outputs the current I by way of I/O 29-1.

In the decision section 26, step S11 records the decision reference data in a memory (not shown). The decision reference data will be discussed later in detail.

In the current control section 25, step S12 determines whether the servo-motor 4 has received the current I during the time t, and if the decision is NO, the steps S10 and S11 are executed again.

In the speed control section 24, step S13 reversely rotates the servo-motor 4 with a predetermined acceleration, and, if step S14 decides that the motor rotation has reached a uniform speed, the following step S15 controls the motor such that it rotate at the uniform speed. When the next step 16 determines that the crimper has come to the deceleration starting position, the following step S17 decelerates the motor and step S18 stops the motor rotation based on the arrival at a stopping position.

In the decision section 26, step S19 determines whether the latest crimping operation has been normal based on the data recorded in step S11. Then, the following step S20 displays the results in a crimp monitor 21 and also outputs a warning signal in the case of an abnormal crimping operation.

Figure 8A:
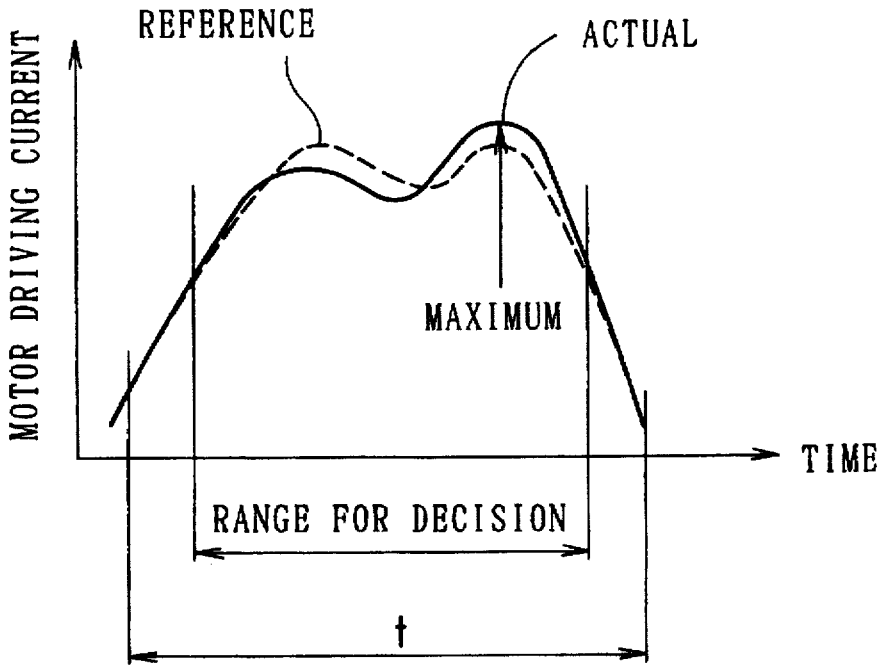
FIG. 8A is a graph explaining a method for determining whether crimping is normal based on the motor driving currents.

For determining whether the crimping operation is normal, as shown in FIG. 8A, step S11 records current values (driving current), which are detected in the current detecting section 28 and, supplied to the servo-motor 4 at a constant time interval.

FIG. 8A shows the driving current supplied to the motor 4 at the crimping operation in FIG. 7B. The current control section 25 controls in such way that standard currents, the values of which are stored in the data storage section, are supplied to the motor. In the motor stopping state, a uniform current is supplied to the motor, while the motor driving current changes when the motor begins to rotate to result in a modified control balance. When a terminal is just crimped, if there are no cores in the cable or if an insulated wire is crimped, the supplied current becomes smaller or larger than the standard current in the normal crimping operation. Accordingly, in the present invention, whether the crimping is normal is decided based on thus changed current supplied to the motor.

Figure 8B:
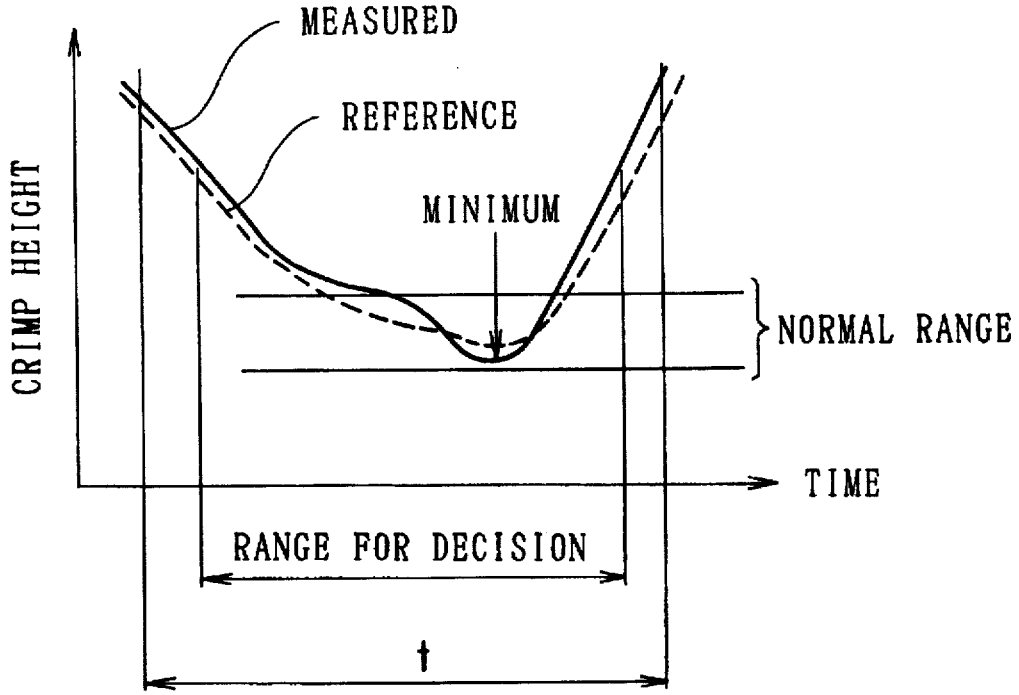
FIG. 8B is a graph for explaining a method for determining whether crimping is normal based on the detected crimper heights.
Figure 9:
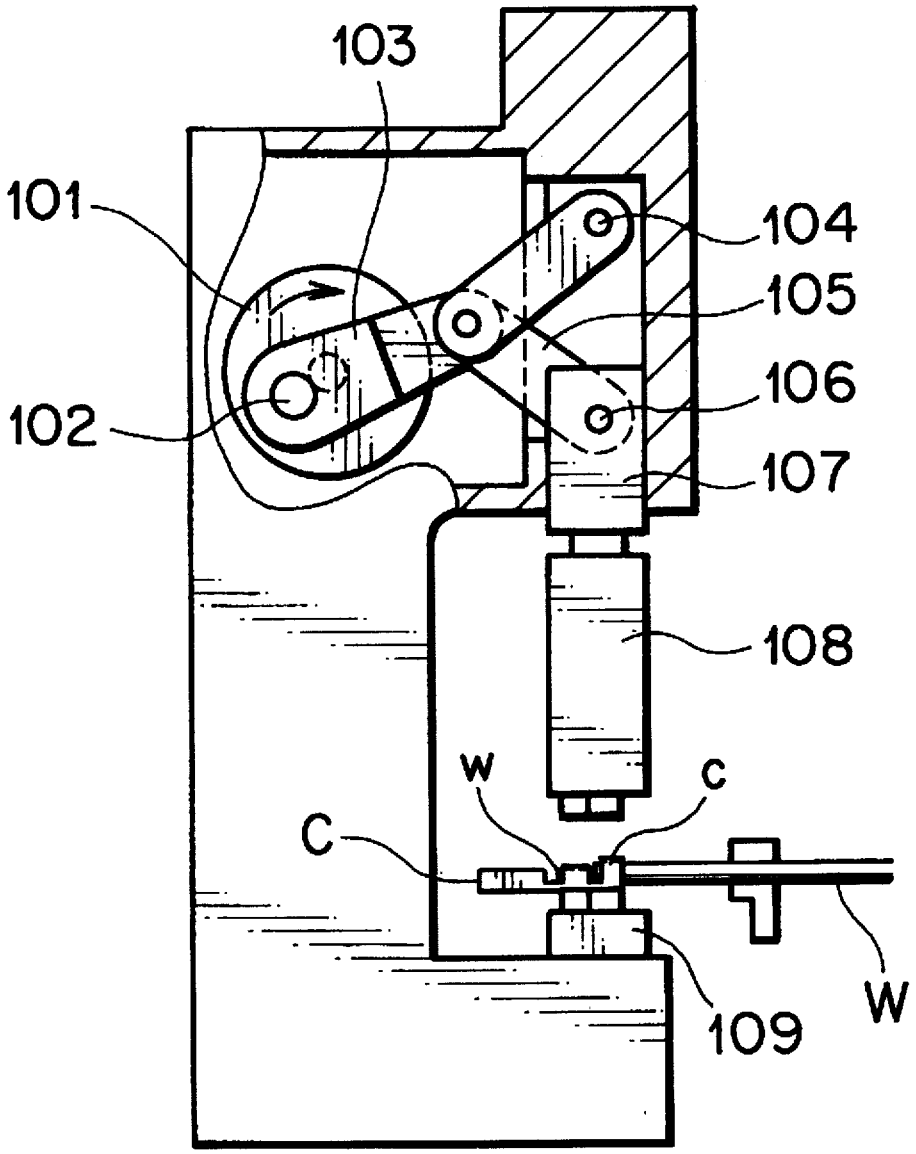
FIG. 9 PRIOR ART
FIG. 9 is an illustration explaining a terminal crimping apparatus of the prior art.
Figure 10:
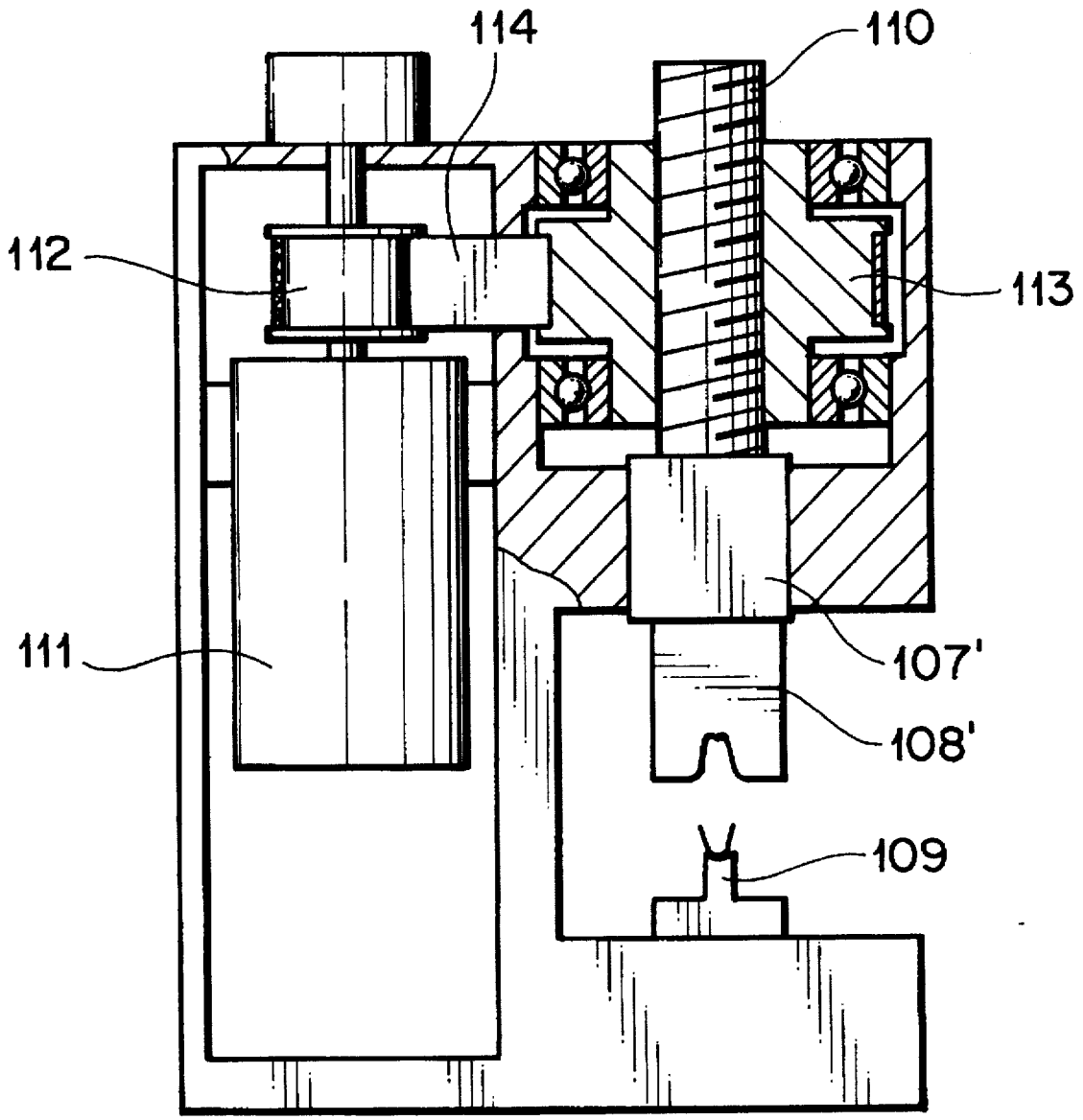
FIG. 10 PRIOR ART
FIG. 10 is an illustration explaining another terminal crimping apparatus of the prior art.
Figure 11:
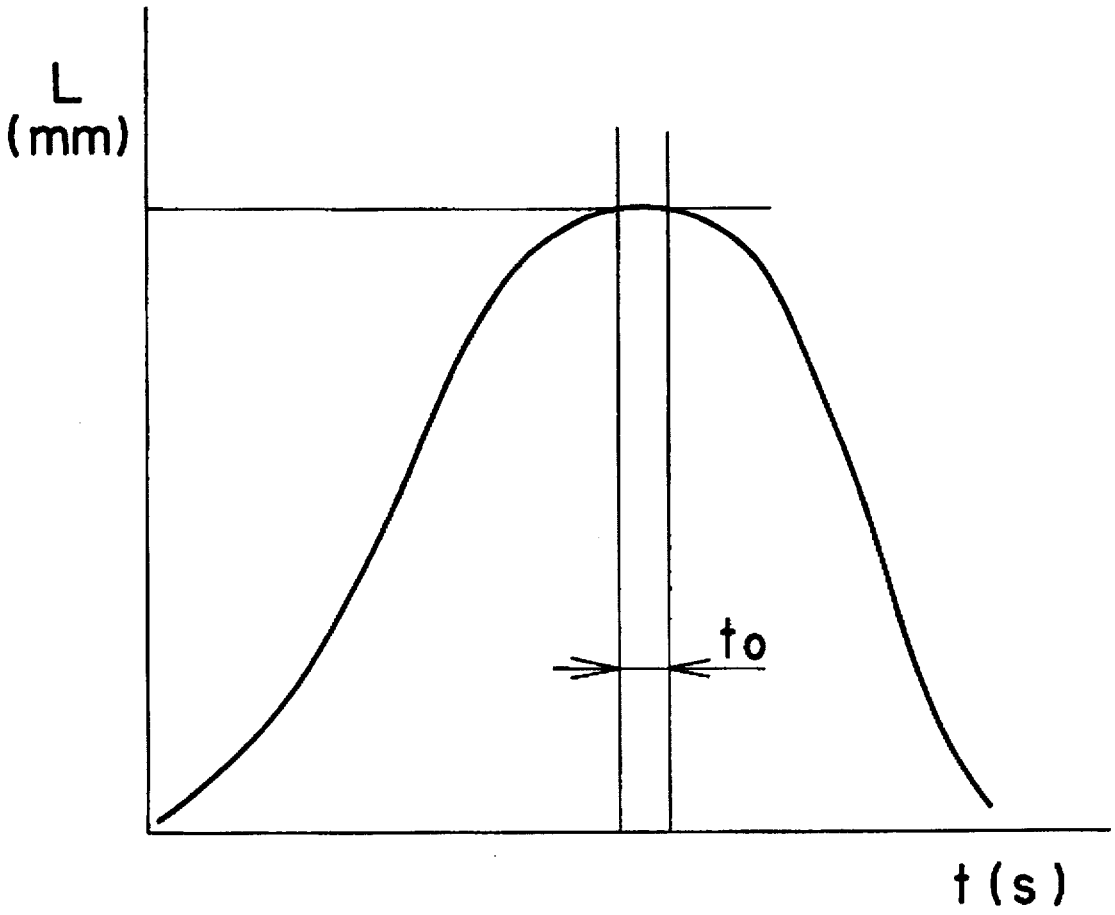
FIG. 11 PRIOR ART
FIG. 11 is a typical graph showing the relation between time and the position of a crimper in a terminal crimping operation regarding a terminal crimping apparatus of the prior art.

Further, FIG. 8B shows an output from the height sensor 32 when a terminal is crimped. Naturally, when a terminal is just crimped, if there are no cores in the cable, or if an insulated wire is crimped, the resulting crimp height outputted at each time interval becomes lower than, or is different from, the normal crimp height. Therefore, in the present invention, whether the crimping is normal is determined based on the thus changed crimp height.

A first decision method, as shown in FIG. 8A, includes the steps of: reading out a maximum value among driving currents recorded in the step S11 in a predetermined period; determining whether the maximum value is within the standard values stored in the data storage section 23; and determining whether the crimping has been normally carried out based upon whether the maximum value is within the range of the standard values.

A second decision method includes the steps of: recording reference currents during a predetermined period in the data storage section 23; obtaining the differences between the time series current values recorded in the step S11 and the reference currents; and deciding whether the crimping has been normally carried out based upon whether the difference is within a predetermined range.

A third decision method includes the steps of: obtaining the sum of the current values recorded in the step S11 at a constant interval during a predetermined period; and deciding whether the crimping has been normally carried out based upon whether the sum is within a predetermined range.

A fourth decision method includes, as shown in FIG. 8B, the steps of: recording heights outputted from the height sensor 32 by way of I/O 29-5 in data recording of the step S11; obtaining a minimum value among the recorded data; and deciding whether the crimping has been normally carried out based upon whether the minimum value is within a predetermined range.

A fifth decision method includes the steps of: recording heights outputted from the height sensor 32; obtaining a minimum value among the recorded data; and comparing the time series heights with the corresponding reference values, and deciding whether the crimping has been normally carried out based upon whether the differences are within a predetermined range.

Moreover, the decision may be carried out based on both the driving current and the crimper height.

In the embodiment of the present invention, as mentioned above, the off-center pin 8 pivots within the range of 0 to 180 degrees and a crimp height (the lowest position of the crimper 14) is adjusted by the pivoting range of the off-center pin 8. That is, random adjustments of crimp height are capable by controlling the number of rotation e in the servo-motor 4 by the driver control device 34.

Further, monitoring load currents I in the servo-motor 4 or monitoring the height of the crimper 14 can determine whether the crimping operation is normal or not, that is, whether a product is non-defective during crimping operation. Moreover, a stopping period t is provided in crimping operation so that the terminal barrel is prevented from its spring-back, resulting in reliable, stable crimping and reliable products.

In the above-mentioned crimping method, the normally and reversely rotating electrical servo-motor 4 is adopted to vertically reciprocate the crimper 14, the electrical servo-motor may be replaced by a hydrostatic servo-motor.

What is claimed is:

1. A method of controlling a terminal crimping apparatus that is equipped with a vertically reciprocating crimper for crimping a terminal to an exposed conductive portion of an electric wire and an anvil opposing to said crimper, wherein said crimper is activated in the vertical direction by an activation means having a servo-motor and a piston-crank mechanism, said method comprising the steps of:

monitoring load currents applied to said servo-motor when the terminal is crimped; and comparing the monitored load currents with predetermined reference currents to obtain the difference therebetween; and deciding whether the terminal is correctly crimped based upon the obtained difference between the monitored load current and the reference load current.

2. A method of controlling a terminal crimping apparatus as claimed in claim 1, wherein said monitoring operation of the load currents applied to said servo-motor is conducted at a terminal crimping position.

3. A method of controlling a terminal crimping apparatus as claimed in claim 1 or 2 further comprising the step of deciding whether the crimping has been normally carried out based on that the maximum value of the load currents during a predetermined period is within an allowable range of said reference currents.

4. A method of controlling a terminal crimping apparatus as claimed in claim 1 or 2 further comprising the step of deciding whether the crimping has been normally carried out based on the differences between the load currents and the reference currents during a predetermined period.

5. A method of controlling a terminal crimping apparatus as claimed in claim 1 or 2 further comprising the step of deciding whether the crimping has been normally carried out based on that the sum of the load currents during a predetermined period.

6. A method of controlling a terminal crimping apparatus that is equipped with a vertically reciprocating crimper for crimping a terminal to an exposed conductive portion of an electric wire and an anvil opposing to said crimper, wherein said crimper is activated in the vertical direction by an activation means having a servo-motor and a piston-crank mechanism, said method comprising the steps of:

monitoring load currents applied to said servo-motor when the terminal is crimped;

comparing the detected load currents with predetermined allowable reference currents to obtain a difference therebetween;

monitoring a height of said crimper when the terminal is crimped;

comparing the monitored crimper height with a predetermined reference crimper height to obtain a difference therebetween; and deciding whether the terminal is correctly crimped based upon the difference between the detected load current and the reference current and the difference between the monitored crimper height and the reference crimper height.

7. A method of controlling a terminal crimping apparatus as claimed in claim 6, wherein said monitoring operation of the height of the crimper is conducted around a terminal crimping position.

8. A method of controlling a terminal crimping apparatus as claimed in claim 6 or 7 further comprising the step of deciding whether the crimping has been normally carried out based on the minimum value of the crimper height during a predetermined period.

9. A method of controlling a terminal crimping apparatus as claimed in claim 6 or 7 further comprising the step of deciding whether the crimping has been normally carried out based on the difference between the crimp height and a reference crimp height during a predetermined period.

10. A method of controlling a terminal crimping apparatus that is equipped with a vertically reciprocating crimper for crimping a terminal to an exposed conductive portion of an electric wire and an anvil opposing to said crimper, wherein said crimper is activated in the vertical direction by an activation means including a servo-motor, said method comprising the steps of:

monitoring load current applied to said servo-motor when the terminal is crimped;

comparing the monitored load current with predetermined reference currents to decide whether the terminal is correctly crimped; and detecting air temperature surrounding said servo-motor to correct the load current applied to the servo-motor in response to temperature.

* * * * *